United States Patent [19]

Prunbauer et al.

[11] Patent Number: 4,612,787

[45] Date of Patent: Sep. 23, 1986

[54] ARRANGEMENT FOR CYLINDER LOCKS

[75] Inventors: Kurt Prunbauer, Herzogenburg; Adalbert Paar, Vienna, both of Austria

[73] Assignee: EVVA-Werk Spezialerzeugung Von Zylinder- und Sicherheitsschlössern m.b.H. & Co., Kommanditgesellschaft, Vienna, Austria

[21] Appl. No.: 576,534

[22] Filed: Feb. 2, 1984

[30] Foreign Application Priority Data

Feb. 4, 1983 [AT] Austria ..... 399/83
Jun. 28, 1983 [AT] Austria ..... 2373/83

[51] Int. Cl.[4] ..... E05B 27/06

[52] U.S. Cl. ..... 70/358; 70/364 A; 70/409

[58] Field of Search ..... 70/358, 364 A, 364 R, 70/360, 276, 409, 419, 421

[56] References Cited

U.S. PATENT DOCUMENTS

| | | | |
|---|---|---|---|
| 2,295,737 | 9/1942 | Johnstone | 70/364 A |
| 3,413,831 | 12/1968 | Crepinsek | 70/364 A |
| 3,605,463 | 9/1971 | Epstein | 70/419 X |
| 3,908,417 | 9/1975 | Beudat | 70/364 A |
| 4,111,019 | 9/1978 | Rabinow | 70/358 |
| 4,116,025 | 9/1978 | Wolter | 70/409 X |
| 4,168,617 | 9/1979 | Prunbauer | 70/409 X |
| 4,289,002 | 9/1981 | Gretler | 70/358 |
| 4,294,091 | 10/1981 | Prunbauer | 70/360 X |
| 4,343,166 | 8/1982 | Hofmann | 70/358 |

FOREIGN PATENT DOCUMENTS

| | | | |
|---|---|---|---|
| 400454 | 8/1924 | Fed. Rep. of Germany | 70/358 |
| 3038318 | 6/1981 | Fed. Rep. of Germany | 70/372 |
| 1443313 | 5/1966 | France | 70/409 |
| 1563400 | 3/1980 | United Kingdom | 70/358 |

*Primary Examiner*—Gary L. Smith
*Assistant Examiner*—Lloyd A. Gall
*Attorney, Agent, or Firm*—Michael J. Striker

[57] ABSTRACT

Disclosed are cylinder lock arrangements which include a rotatable cylinder plug provided with recesses for guiding in axial direction blocking bars which cooperate with the cylinder housing to prevent in a blocking position thereof the rotation of the plug. The blocking bars are formed with blind bores which in a releasing axial position of the bars communicate with a key channel. The blind bores accommodate segmented pin tumblers which are controlled by control recesses on a lateral wall of a key so that upon the insertion of a correct key the separation planes of the segments of the pin tumblers coincide with the separation plane between the blocking bar and the clyinder plug. The key for the lock of this invention has a profile defined by alternating longitudinal ribs and longitudinal grooves whereby the crest regions of the ribs are formed with the control recesses arranged at different levels in accordance with the segments of the pin tumblers.

10 Claims, 27 Drawing Figures

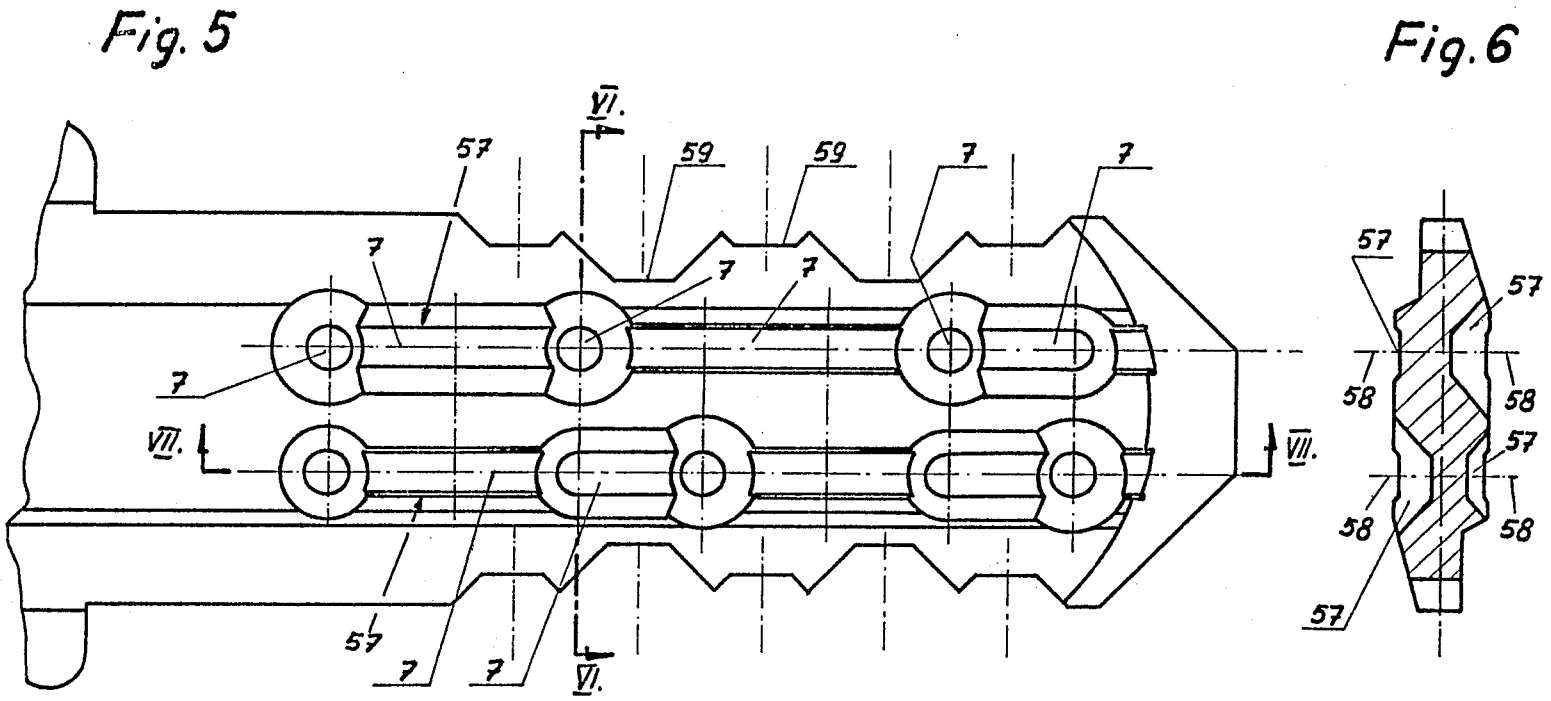
Fig. 6
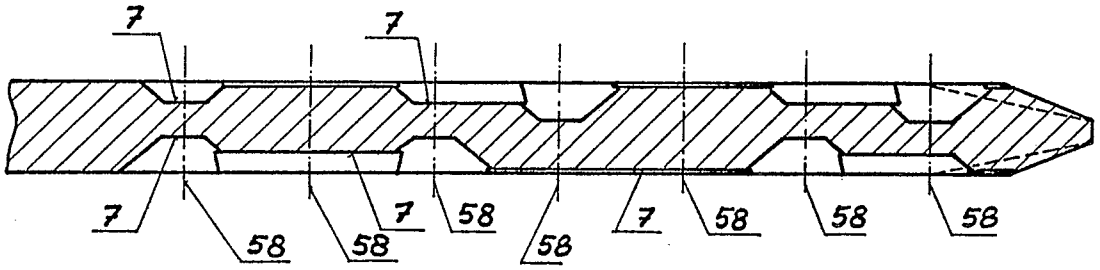
Fig. 7
Fig. 5

ARRANGEMENT FOR CYLINDER LOCKS

BACKGROUND OF THE INVENTION

The invention relates in general to cylinder locks of the type including a cylinder housing, a cylinder plug rotatable in the housing, the cylinder plug having a key channel and at least one blocking bar arranged for axial displacement between a blocking position in which it blocks the rotation of the plug relative to the housing and a releasing position in which it permits the rotation of the plug, whereby the axial displacement of the blocking bar is subject to operation of a key inserted into the key channel.

Cylinder locks of this kind are known in the construction of magnetic cylinder locks. In this prior-art construction, there are employed permanent-magnet rotors for sensing a locking information introduced by a key.

SUMMARY OF THE INVENTION

A general object of the present invention is to provide a cylinder lock of the aforedescribed kind which can dispense with the magnetic rotors and which provide blocking bars in the plug which are controllable by purely mechanical means.

An additional object of the invention is to provide such an improved cylinder lock which can be manufactured at low cost.

A further object of the invention is to provide such an improved cylinder lock which can be employed under any environmental conditions.

In keeping with these objects and others which will become apparent hereafter, one feature of the invention resides, in a cylinder lock of the aforedescribed type, in a combination which comprises radially directed bores in the blocking bar to receive segmented pin tumblers, the bores communicating with the key channel so that upon insertion of a key the separation plane of segmented pin tumblers coincides with the separation plane of the blocking bar and the cylinder plug.

According to another feature of this invention, each blocking bar is provided with an axially outwardly directed blocking piece which is guided in an axial groove in the inner wall of the housing and which, in a releasing position of the blocking bar, is in alignment with an annular groove in the inner wall of the housing, which permits the angular displacement of the plug about its center axis. The axial displacement of the blocking bar is determined by a stop ring which surrounds the plug and is formed with a recess having sloping run-up surfaces which cooperate with corresponding run-up surfaces at the ends of the blocking bar. After insertion of a key in the key channel, and by rotating the key, the run-up surfaces of the blocking bar slide on the run-up surfaces of the stop ring, thus displacing the bar in the desired releasing axial position. The stop ring is coupled to the cylinder housing by a load limit coupling. In the preferred embodiment of this invention, the blocking bar is formed with lateral shoulders which engage a corresponding undercut in the recess of the plug for guiding the bar. In this manner, the blocking bar is secured against radial displacement. The segmented pin tumblers and the corresponding bores can be stepped down, whereby the segment of the tumbler adjoining the key channel is of a smaller diameter. According to this invention, the blocking bar extends parallel to the key channel in the plug and the profiled control surfaces of the key are provided on the lateral sides of the latter. In the preferred embodiment of this invention, the segment of the pin tumbler which remains in the confines of the blocking bar is provided with a recess for accommodating a biasing spring which at one end rests on the bottom of a blind bore in the blocking bar and its other end engages the pin tumbler.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 5 is another embodiment or tne present invention;

FIGS. 6 and 7 show different sectional views of the key of FIG. 5;

DESCRIPTION OF THE PREFERRED EMBODIMENTS

Figure 1:
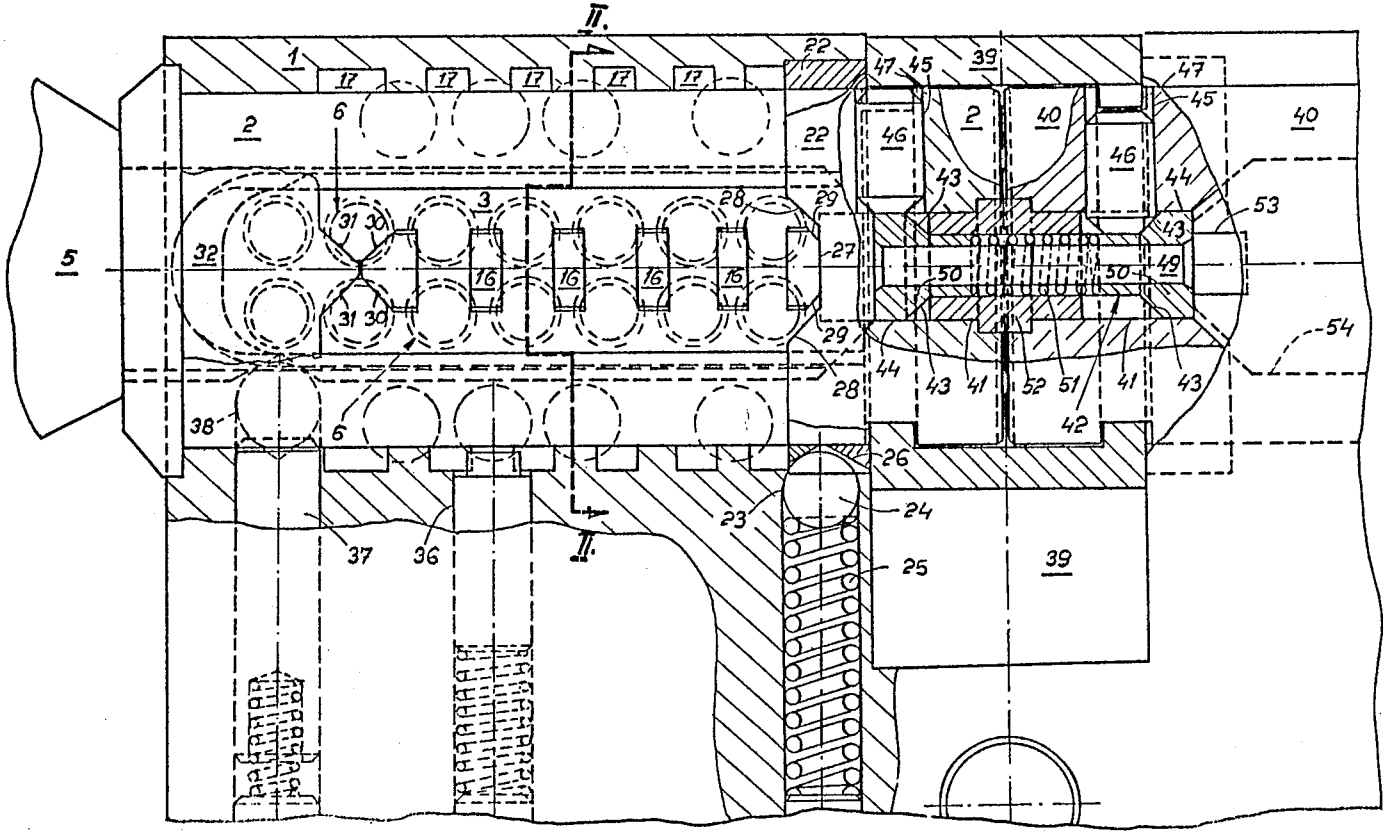
FIG. 1 is a sectional view of a cut-away part of a double cylinder lock of this invention, taken along the line I—I in FIG. 2.

Referring firstly to FIGS. 1–8, there is illustrated a first characteristic feature of this invention, namely the combination of segmented pin tumblers with the axially shiftable blocking bar which displaces the segmented tumblers against control recesses or control lands on a key bit.

In a cylinder housing 1, a cylinder plug 2 is arranged for rotation. A key channel 4 extends along the center axis of the plug 2 and is shaped for receiving a key 5. A blocking bar 3 is arranged for axial displacement at each major side of the key channel 4. Each blocking bar 3 is guided in a recess 11 formed in the plug 2 parallel to the key channel. Each blocking bar 3 has a substantially T-shaped cross section, whereby the shoulders 18 engage corresponding undercuts 10 in the axial recesses 11. In this manner, the blocking bar 3 is free to move in axial direction but is prevented from moving in radial direction.

The outer cylindrical surface cf each blocking bar which engages the inner wall of housing 1 is provided with massive blocking extensions 16 projecting into an axial groove 19 in the inner wall of the housing. The axial groove 19 communicates with radial ring-shaped grooves 17 which correspond in cross section to the cross section of blocking extensions 16. Due to the straight axial groove 19, the blocking pieces 16 and hence the blocking bar 3 is free to move in axial direction. The arrangement of annular groove 17 is such that at a certain axial position of the bar 3, all blocking extensions 16 are flush with the annular groove 17, and the cylinder plug can be rotated without obstruction.

Each blocking bar 3, as well as the adjoining part of plugs 2, are formed with bores 12 communicating with the key channel 4. The segmented pin tumblers 6 are arranged for movement in the bores 12, whereby in a releasing axial position of the blocking bars 3 the bores 12 in the plug are in alignment with the bores 12 in the bars. Preferably, the bores 12 in the plug are formed with a step, and the pin tumbler segment communicating with the key channel is provided with a flange which abuts against the step and permits the tumbler segment to enter the key channel to a limited extent only. The upper segments of the pin tumblers 6 located in the blocking bar 3 are formed with a well 13 for receiving a biasing spring 14 which rests on the bottom of the blind bore 12 in the bar and biases the pin tumblers in the direction of the key channel.

The segments of pin tumblers 6 are separated along separation planes 8. If desired, intermediate disks 21 can be inserted between the segments of respective pin tumblers, so that the latter are divided along several separation planes.

The lateral surfaces of the key 5 are formed with control recesses or lands 7, which as will be explained below can be constituted by the bottoms of blind bores in the lateral sides of the key. The depths of different control lands 7 varies according to a pattern which differentiates individual locks and keys one from the other. Depending on the depth and mutual arrangement of these control surfaces or lands 7, the pin tumblers 6 after insertion of a correct key are displaced by the biasing spring 14 to a position in which the separation surfaces 8 of all pin tumblers coincide with the separation plane 9 between the blocking bar 3 and the cylinder plug 2. Accordingly, after the insertion of a correct key, the blocking bars 3 are free to move in their axial direction.

The axial displacement of the blocking bars 3 is accomplished in a known manner by means of run-up surfaces 29 at the end of each blocking bar, engaging correspondingly sloping run-up surfaces 28 of a stop ring 22 (FIG. 1). The stop ring 22 is secured to the cylinder housing 1 by means of a load limit coupling 23. In this embodiment, the coupling is in the form of a catch ball 24 biased by a spring 25 against a conical recess 26 in the ring 22. The end face of the stop ring 22 is formed with trough-shaped recesses 27 assigned to respective blocking bars 3. As mentioned before, the end of each blocking bar is formed with sloping run-up surfaces 29 engaging the corresponding sloping surfaces 28 at the sides of the recesses 27, so that during rotation of the plug by the key each blocking bar is displaced in axial direction to its releasing position in which the blocking extensions 16 are in alignment with the annular recesses 17 in the housing. For example, in the illustration of FIG. 1, during the rotation of plug 2, the blocking bar 3 is displaced to the left until the extensions 16 are opposite the recesses 17 and the plug can be freely rotated. Similarly, when the plug is rotated by the key in opposite direction, the blocking bars 3 are returned in the position shown in FIG. 1 by the interaction of run-up surfaces 30 and 31 at the other end of each blocking bar. The sloping or run-up surfaces 31 are formed on a ring 32 which is inserted in a corresponding recess in the housing. The counteracting run-up surfaces 30 are formed on the blocking bar 3.

Provided that after the insertion of an incorrect key the segmented pin tumblers prevent the axial displacement of the blocking bar 3, then the run-up surfaces 29 of the bar remain in the trough-shaped recess 27 of the stop ring, and the rotation of key 5 is transmitted via the cylinder plug 2 on the stop ring 22. When a certain limit force is applied to the key which overcomes the holding limit of the coupling 23, the stop ring 22 is disengaged from the ball 23 and rotates together with the cylinder plug 2 until the blocking extensions 16 abut against the lateral walls of the elongated recess 19 in the inner wall of the housing. As a consequence, the rotation of the plug is stopped by the massive blocking pieces 16 and the lateral walls 33 of the longitudinal recess 19.

Figure 2:
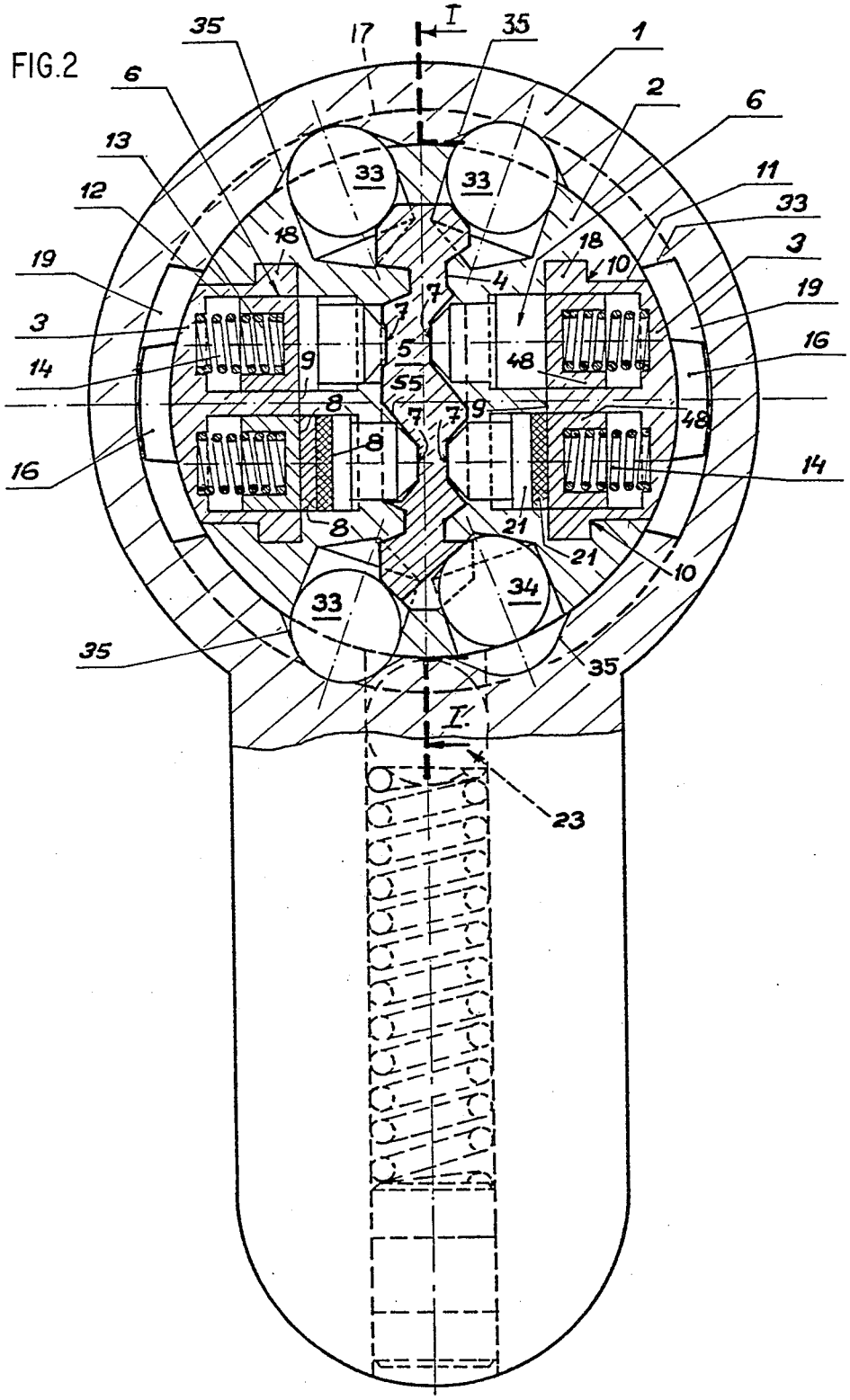
FIG. 2 is a sectional view of the lock of FIG. 1 taken along the line II—II.

In the embodiment according to FIGS. 1 and 2, there are also provided blocking balls 33 and 34 which increase the number of variations of blocking balls of the lock. The balls 33 and 34 seat in corresponding recesses in the cylinder plug and cooperate with control edges or control surfaces of the key. Balls indicated by reference numeral 33 are displaced by control edges of the key into engagement with blocking recesses in the inner wall of the housing, thus preventing rotation of the cylinder plug. That means the key illustrated in FIG. 2 is an incorrect key. Ball 34, due to the recess in the adjoining edge of the key, is displaceable inwardly in its recess, so as to permit the rotation of the cylinder core. In the case of a correct key, it would be necessary that all four balls shown in FIG. 2 be displaced radially inwardly similarly as the ball 34.

In FIG. 1, reference numeral 36 denotes a control pin in the housing which is spring-biased against a blocking ball in the plug. This arrangement makes the provision of locking balls necessary, since otherwise the control pin 36 would enter the recess of the blocking ball and would arrest the movement of the plug. In addition, FIG. 1 also illustrates key holding pin 37 which is spring-biased against a ball in the plug 2. The top of the pin 37 is formed with a conical recess which serves as an indexing catch for setting accurately the central position of the cylinder plug for inserting the key.

FIG. 1 also illustrates a new coupling structure for interconnecting two cylinder plugs 2 and 40 in a double cylinder lock unit of this invention. The mating end surfaces of the plugs 2 and 40 are surrounded by a locking nose ring 39. The coupling construction is located in axial bores 41 formed in respective end faces of the plugs 2 and 40. The coupling consists of a tubular device 42 which at both ends thereof is extended into a flange 44 of a larger diameter and transits into the intermediate part by sloping abutment surfaces 43. The coupling device 42 is movable in both axial directions in the bores 41. Transverse bores 45 communicate with the axial bore 41 in each of the two plugs and accommodate cylindrical coupling pieces 46 which are shiftable towards the coupling device 42. The ends of coupling pieces 46 are bevelled and cooperate with the inclined run-up surfaces 43, whereas at the other end they are engageable with recesses 47 in the inner wall of the locking nose ring 39. In FIG. 1, a key 5 is inserted in the left plug 2 so that the tip of the key bit displaces the coupling bolt 42 to the right. The coupling piece 46 in this position rests on the flange part 44 of increased diameter, and consequently its opposite end engages the recess 47 in the locking nose ring. Consequently, the latter ring is rotated together with the left plug 2. At the same time, the right-hand coupling piece 46 drops against the intermediate part of the coupling bolt 42 of smaller diameter and disengages the corresponding recess 47 in the locking nose ring 39. In this decoupling position of the right-hand coupling piece, the right-hand cylinder core 40 is disconnected from the core 2.

The coupling device 42 can be machined as a single piece in which the two flanged regions 44 of increased diameter are permanently spaced one from the other. In the embodiment shown in FIG. 1, however, the coupling device 42 is assembled of several parts. The latter design is suitable for an emergency actuation of the lock by means of an emergency key shown in FIG. 4. The coupling device 42 in this embodiment is assembled of a bolt 49 which supports on each end thereof a coupling sleeve 50. The two coupling sleeves 50 are resiliently spaced apart by a pressure spring 51. In addition, there is provided an intermediate spacer sleeve 52 by means of which the two coupling sleeves are guided and protected against lateral pressures.

The function of an emergency key is as follows: In FIG. 1, a normal key is inserted in the left plug 2, whereby as mentioned before the coupling device 42 is shifted to the right. An emergency key having at its tip a rectangular recess 53 is inserted in the right-hand plug 40. As will be explained below in connection with FIG. 4, the emergency key possesses, apart from the recess 53, longitudinal recesses on its major lateral sides which cooperate with the pin tumblers so as to displace the latter in a non-locking position, even if the key is not yet fully inserted into the key channel.

Thereafter, the emergency key 54 by the application of certain torque rotates the plug 40 to such an angular position in which the right-hand coupling pin 46 is opposite the recess 47 in the inner wall of the locking nose ring 39 and enters this recess. Its preliminary rotation is necessary only then when the inserted left-hand key 5 is stuck in a turned position. Otherwise, the recess 47 is flush with the corresponding coupling piece 46 during the insertion of the emergency key. After a further insertion of the emergency key in the key hole, the corresponding coupling sleeve 50 is displaced against biasing spring 51 inwardly, so that the coupling piece 46 is shifted along the inclined run-up surface 43 upwardly and enters the recess 47 of the ring 39. As a consequence, the emergency key 54 is firmly coupled to the locking nose ring 39, so that the latter can be rotated and the lock activated. In this manner, the two cylinder plugs 2 and 40 are positively connected one to the other for joint rotation.

The locking nose ring 39 is provided with claws 100 engaging annular cut-outs 101 in the adjoining ends of the two cylindrical plugs, so that the latter are protected against disengagement in axial direction.

If instead of an emergency key 54 a standard key without the recess 53 at its tip is employed, then the tip abuts against the bolt 50 of the coupling device 42 and a complete insertion of the standard key into the key channel cannot be achieved.

Figure 3:
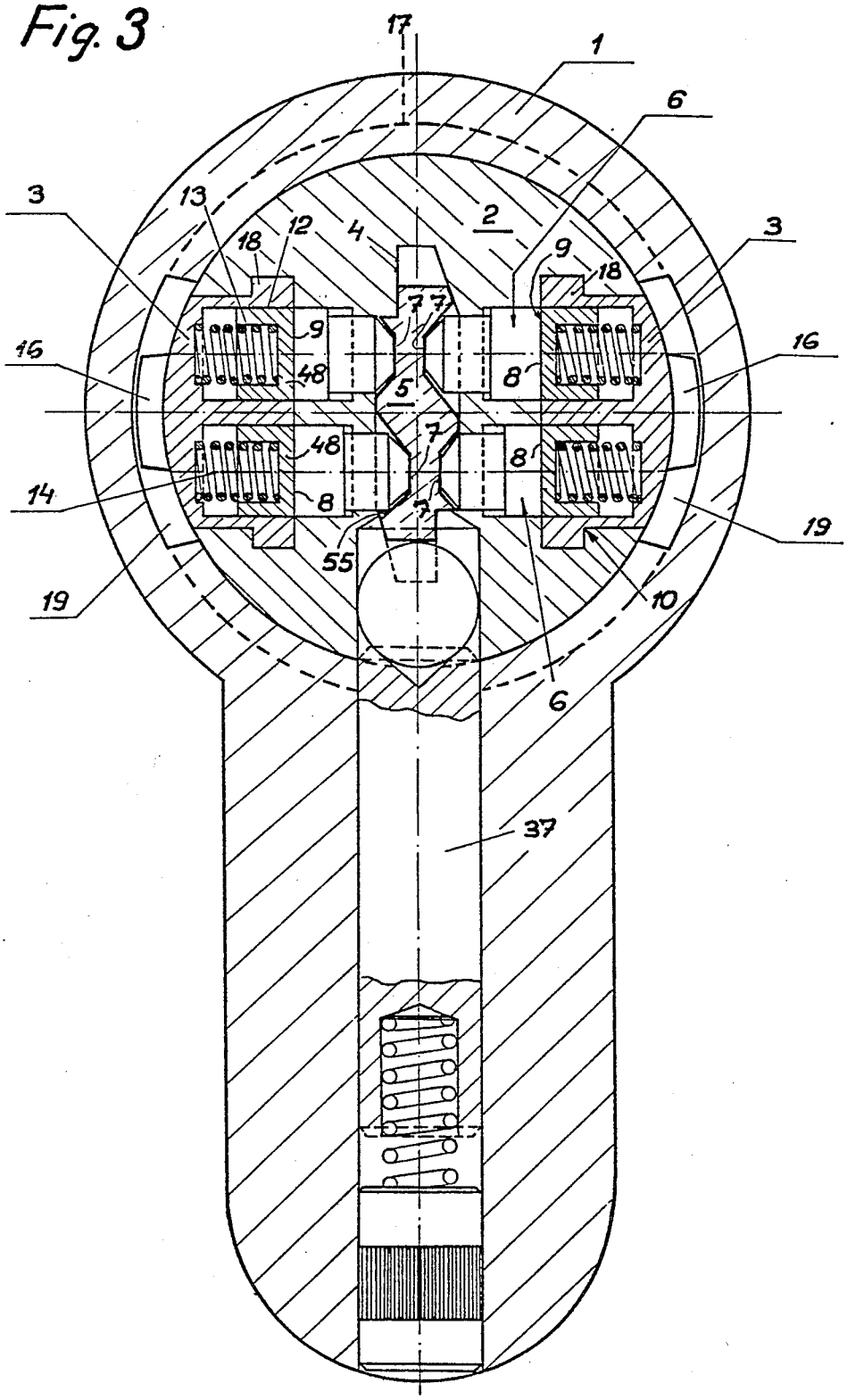
FIG. 3 is a sectional view similar to FIG. 2 of another embodiment of the lock of this invention.

FIG. 3 illustrates a modification of the embodiment of the cylindrical lock of FIG. 2. In this modification, the blocking balls 33 and 34 are dispensed with. The key holding pin 37 is preferably made of a hard metal to serve as a protection against drilling of the lock.

Figure 4:
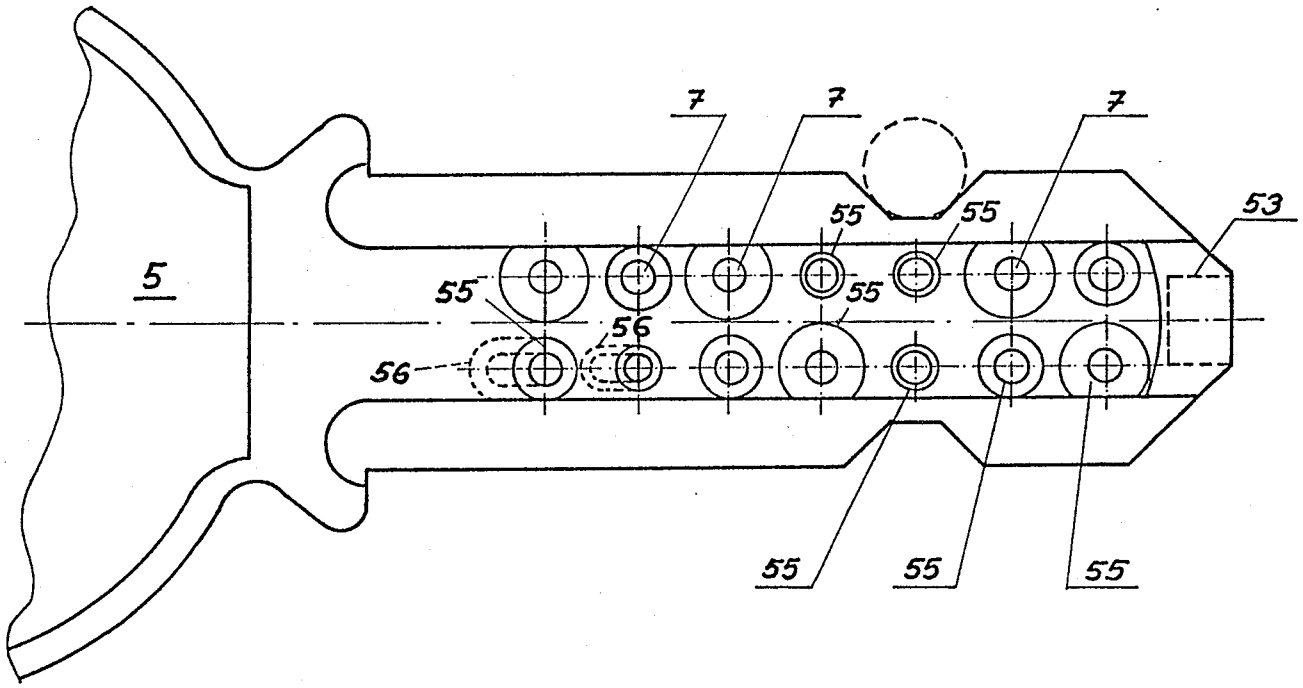
FIG. 4 is a side view of a key for use with the lock of this invention.

FIG. 4 shows in a side view the construction of a key which may be used for the embodiment of the lock as shown in FIG. 3. Control surfaces 7 for adjusting the position of the pin tumblers are produced by blind bores 55 of different depths. These control surfaces, however, can be produced also in a different way, for example in the form of continuous grooves or webs in the lateral walls of the key bit with oblique transition surfaces between the different levels of the control surfaces.

In another modification, some of the blind bores 55 are extended in axial direction into oval recesses 56 oriented in the axial direction of the key as indicated by dashed lines. If all control surfaces are prolonged in this way, then the key can be used as an emergency key by providing the tip of its bit with a rectangular cut-out 53 (also indicated by dashed lines) whose function was described before.

With regard to the construction of the lock according to FIG. 1, it will be noted that the run-up surfaces 30, 31, serving for returning the blocking bar to its initial position, can be replaced by a suitable return spring. Furthermore, it will also be noted that the recess 27 in the stop ring 22 should be designed so as to permit a certain idle travel at both sides of run-up surfaces 28. This idle travel has the purpose to enable during the insertion of a key a quiet adjustment of the position of the segmented pin tumblers so that only after a predetermined rotation of the cylinder plug the axial displacement of the blocking bars will occur. In this manner, no interference will occur during the actuation of pin tumblers even during the rushed insertion of the key or during application of a torque to the latter. Preferably, the separation surfaces between the cylinder plug and the associated blocking bar as well as the separation surfaces between the segments of pin tumblers are made completely planar within the accuracy range of 0.01 of a millimeter. In conventional pin tumblers whose separation surfaces lie in the interface a cylindrical plug and cylindrical housing, these must be shaped in a corresponding arcuate form. In the fully plane configuration of the separation surfaces in the lock of this invention, a scanning of the tumblers is practically impossible. If an attempt is made to sense the location of pin tumblers in the key channel by means of a spy tool, the latter must have been brought with an accuracy of one-hundredth of a millimeter in the correct position and this in practice is impossible, especially in view of the fact that a large number of such pin tumblers are present.

The number of segmented pin tumblers in spite of the predetermined limitation in size of the cylinder plug can be maintained very large, inasmuch as due to this particular lock construction of the invention they are not exposed to disruptive forces and can be substantially reduced in size.

With the illustrated number of fourteen pin tumblers on each side of the key channel, the three possible lengths of the pin tumblers, there result twenty-two billion possible variations. With the provision of sixteen additional balls (according to FIGS. 1 and 2), there are altogether $10^{37}$ variation possibilities. An important feature of this invention resides in the fact that such an extremely high number of locking variations is achieved without impairing the functional reliability and susceptibility to damage of the lock, because the locking function is not performed by the sensitive pin tumblers which can be sensed, but instead it is performed by the massive blocking pieces.

With advantage the construction according to this invention can also be combined with magnetic rotors known from prior-art constructions.

With regard to the function of the control pin 36 it will be also noted that at this point the key must be formed with a longitudinal rib and a corresponding ball which is of a smaller diameter. If such a rib on the proper location of the key is missing, then the ball of reduced diameter falls too far in the cylinder plug and the control pin due to the action of its biasing spring enters into the guiding bore in the cylinder plug, so that the latter is arrested.

The lock of this invention is particularly suitable for designing complicated locking systems. The lock of this invention also meets the requirements of the most complex locking projects.

By virtue of the extremely high number of available variations, it is also made possible to produce a reversible key such as illustrated in FIG. 4, for example, whereby the creation of complex locking systems is still possible.

FIGS. 5–7 illustrate a preferred embodiment of a key for use in the lock of this invention. The contour variations of control surfaces for the segmented pin tumblers in blocking bars 3 correspond to those in the key of FIG. 4. However, these contour variations are not in the form of discrete blind bores 55, but the control lands are created in continuous V-shaped grooves 57 in the lateral sides of the key. The milling of these grooves can be accomplished for example by a frustoconical end milling cutter whose cutting depth is controlled in accordance with the differences of respective segmented pin tumblers in a particular lock. The provision of these longitudinal grooves has the advantage that in inserting the key in the key channel the pin tumblers which are of relatively small dimensions are forced to move with a reduced stroke, and consequently their functional reliability and wear resistance are improved.

The working points of the pin tumblers on control lands 7 are indicated in FIGS. 6 and 7 by dash-dot lines 58. The opposite narrow sides of the key of FIGS. 5–7 is also provided with additional recesses 59 for controlling additional segmented pin tumblers. Both narrow sides of the key bit are profiled mirror-symmetrically relative to the center axis, so that the key be reversible.

Figure 8:
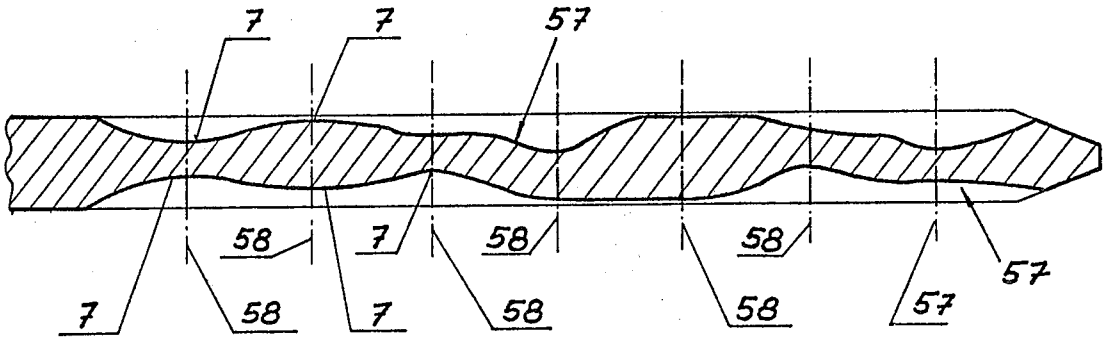
FIG 8 is a longitudinal cross section of a modification of the key of this invention.

FIG. 8 shows in a sectional top view another preferred embodiment of the key according to FIGS. 5–7 in which the profile variations correspond exactly to the key of FIG. 7. In this modification, however, the contour of grooves 57 is not discontinuous but forms a continuous line. The working points 58 for the pin tumblers in this embodiment correspond to the control surfaces 7 in the embodiment of FIGS. 5–7. The continuous contour in the embodiment of FIG. 8 has the advantage of a particularly smooth transition between the individual control surfaces resulting in an increased operational reliability and resistance against wear even after a prolonged use of the key.

It is one feature of this invention to provide a flat key for the cylindrical lock of the aforedescribed type, which has opposite sides provided with recesses for controlling scanning and locking elements within the lock, and which is characterized by a series of control surfaces extending along the central axis of the key bit and which are arranged in a continuous groove, whereby the control surfaces are arranged at different levels in the groove. In the embodiment according to FIG. 8, the flat key is distinguished by continuously curved transitions between the control surfaces in each elongated groove, so that the profile of the bottom of the groove has a continuous wave-like configuration.

In another embodiment, the key for the lock of this invention is provided with longitudinal ribs alternating with longitudinal grooves and the control lands or surfaces are formed on the longitudinal ribs. As mentioned before, the objective of this invention is to provide an increased number of locking variations, to eliminate the possibility of an unauthorized imitation of the key or of the lock, to ensure a permanent high functional reliability of the key and the lock and at the same time to use simple construction parts in the manufacture of such locks which permits a simple series production of the latter. These objectives, in accordance with this invention are achieved primarily by designing a key which in addition to the control profiles on the lateral sides of the key bit, there are also provided control recesses on the crest of longitudinal ribs on the narrow sides of the key bit. In addition, the objectives of this invention are achieved by the combination of the following features:

(a) The segmented pin tumblers which are divided along one or more separation planes, are arranged in blind bores in the blocking bars and in the bores of the cylinder plug, the latter communicating with the key channel so that the segmented tumblers can be shifted to the releasing position by the profiled key only in a predetermined axial position of the blocking bars;

(b) The section shape of the key to be used in a locking system with a plurality of locks of this invention, defines an invariable base profile and an adjustable or variable profile, whereby both the invariable and the variable profile portions are distributed and mutually interconnected in the region of the key bit which is effective for controlling the locking or unlocking function of the lock.

(c) The two features of the combination of the invention are functionally interrelated and solve in an exceptionally advantageous manner the aforementioned objectives.

Figure 9:
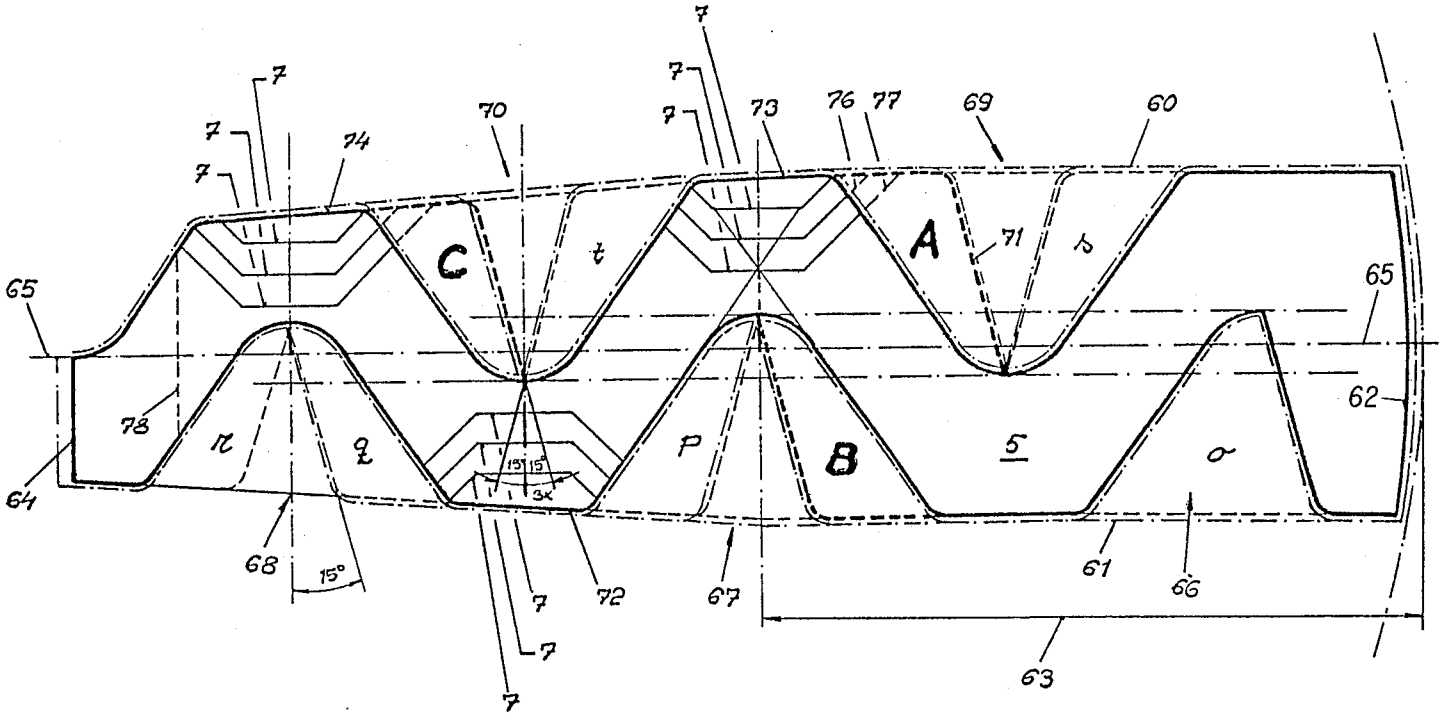
FIG. 9 shows on an enlarged scale a section shape of a key bit of still another embodiment of a key of this invention.

FIG. 9 shows in a sectional side view a section shape of a key according to this invention. The two contour lines 60 and 61 of the broader lateral sides of the key 5 extend substantially parallel one to another over an upper range 63 reaching approximately to the center of the height of the key bit. Below the range 63, the lateral sides of the key bit converge symmetrically to the central plane 65 so as to define an approximately frustoconical cross section.

When designing a certain profile of the key for a lock installation, one starts from a starting or zero profile line indicated by full lines. The zero profile line has a zig-zag shape. Due to this zig-zag configuration there result approximately V-shaped grooves or recessed regions 66–70 of uniform depth which can be selectively filled with the material of the key or shaped as grooves. In concert with the present terminology in the following description, the filled up regions will be referred to as ribs, and the non-filled regions as grooves.

The profiled regions 67–70 are provided with mutually congruent cross sections. Within a cross section of each of these grooves there can be created two ribs or two grooves. In FIG. 9, a rib is provided in each of the grooves 67, 69 and 70, as indicated by dashed lines and designated as base profile ribs A, B and C. The arrangement of these base profile ribs is illustrated by way of an example only. Within a locking installation, the base profile ribs remain always at the same side. The remaining sections of the profile region 66–70 can be shaped either as ribs or as grooves in order to create the desired variations for master keys and subordinated keys. These variation elements are designated by reference characters o, p, q, r, s and t.

An example of a particular arrangement and interrelationship of base profile elements A, B, C and of variation elements o, p, q, r, s, t will be explained in principle below.

The profile region 66 gives room for a single profile element only, which is created either at the rib when this region is fully filled up by the key material or is left as a groove.

If within the confines of respective profile regions 67–70 only a single rib is provided as a profile element, then the section shape has a configuration of an approximately skewed triangle, in which the sides (for example side 71 in the region 69) form an oblique angle with the central plane 65. The complementary groove in this region 69 has then a larger cross-sectional surface than that of the rib (base profile rib A). If, however, the profile region 69 is provided with two ribs, then this region 69 is fully filled up as far as to the contour line 60.

Due to the zig-zag configuration of the zero profile, the profile region, such as 72, 73, 74, reaches up to the contour lines 60 and 61. If the profile region 66–70 are created as grooves, then these regions remain as ribs on the lateral sides of the key.

In the range of sections 72, 73 and 74, there are formed recesses or control surfaces 7 for engaging lateral non-illustrated segmented pin tumblers. The control surfaces are created at different depth levels. In the range of the section 73, there are indicated three different depth levels for the control recesses 7, which may be used in practice. In a completed key 5, of course, only one control surface at the selected level is realized.

As will be explained below, the recessed control surfaces 7 serve for controlling sensing elements (segmented pin tumblers) of a lock, which in turn control the locking mechanism of the latter.

The recessed control surfaces 7 have a frustoconical cross section. In arranging a rib on one or more sides of sections 72–74, the cross-sectional surface of recesses 7 in the contour lines 60, 61 is increased, as indicated in the profile range 69 by dashed lines 76, 77. Nevertheless, it is always ensured, independently from the desired arrangement of ribs or grooves, that material for recesses 7 is always present at the sections 72, 73 and 74. The variation possibilities are independent from the arrangement of the control recesses 7 on the one hand, and of the arrangement of profile ribs or profile grooves on the other hand.

Conventional notches or grooves for additional sensing elements such as pin tumblers or balls can be also made on the key bit 64; however, care should be taken that the control surfaces of the lowermost recess 7 be still in the range of the section 74 as indicated by dashed line 78.

Figure 10:
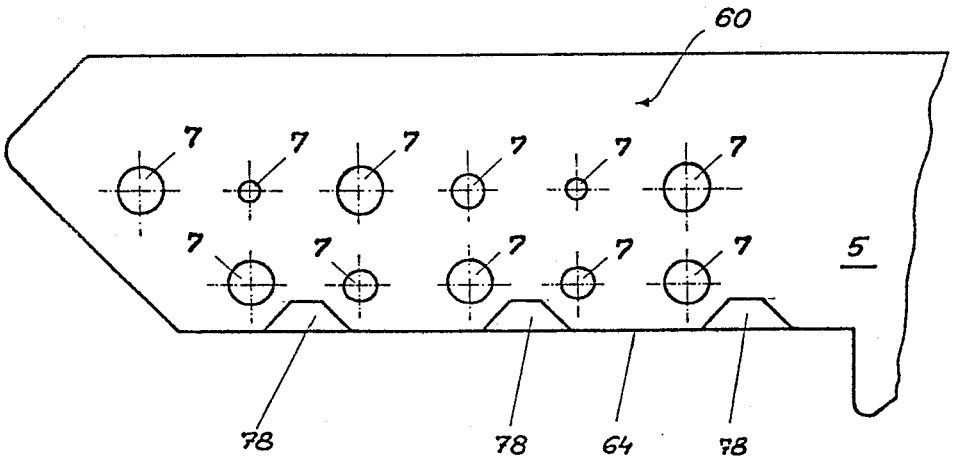
FIGS. 10 and 11 show details of the key of FIG. 9.
Figure 11:
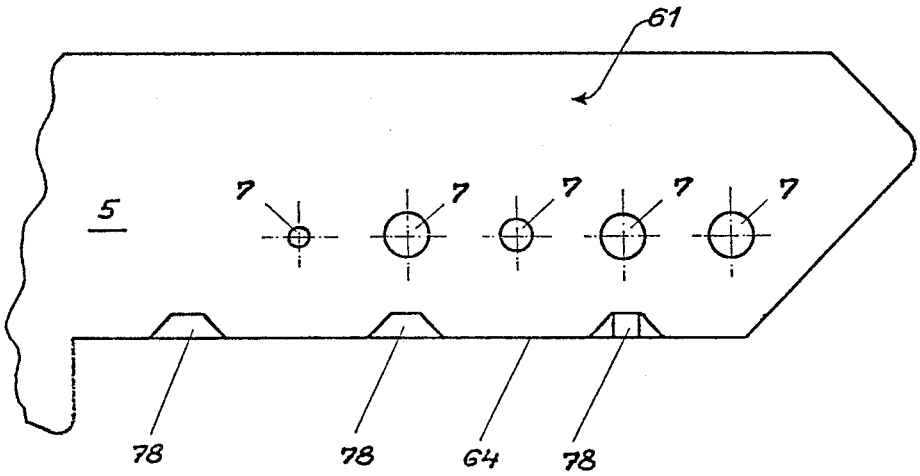

FIG. 10 shows a side view of a lateral side delimited by contour line 60, and FIG. 11 shows the opposite side delimited by the contour line 61 of the key 5. For the sake of simplicity, the profile ranges 66–70 are shown with ribs of filled-up material; only the arrangement of control recesses 7 at different depth levels, as well as the arrangement of notches 78 on the narrow bottom side of the key bit 64, are shown. The notches in the contour line 60 (FIG. 10) are situated in intervals between the consecutive pairs of control surfaces 7, whereas at the opposite lateral side of the key (FIG. 11) the control recesses 7 are arranged at least partially opposite the notches 78. The control recesses 7 at the side enclosed by the contour line 61 are more remote from the bottom of the key bit 64, so that no impairment of the locking function can occur. It will be also noted that in this inventive profile system of the key, the ribs and grooves can overlap each other or can be made without such an overlapping. Also, the spacing of the working points can be uniform or non-uniform if desired.

Figure 12:
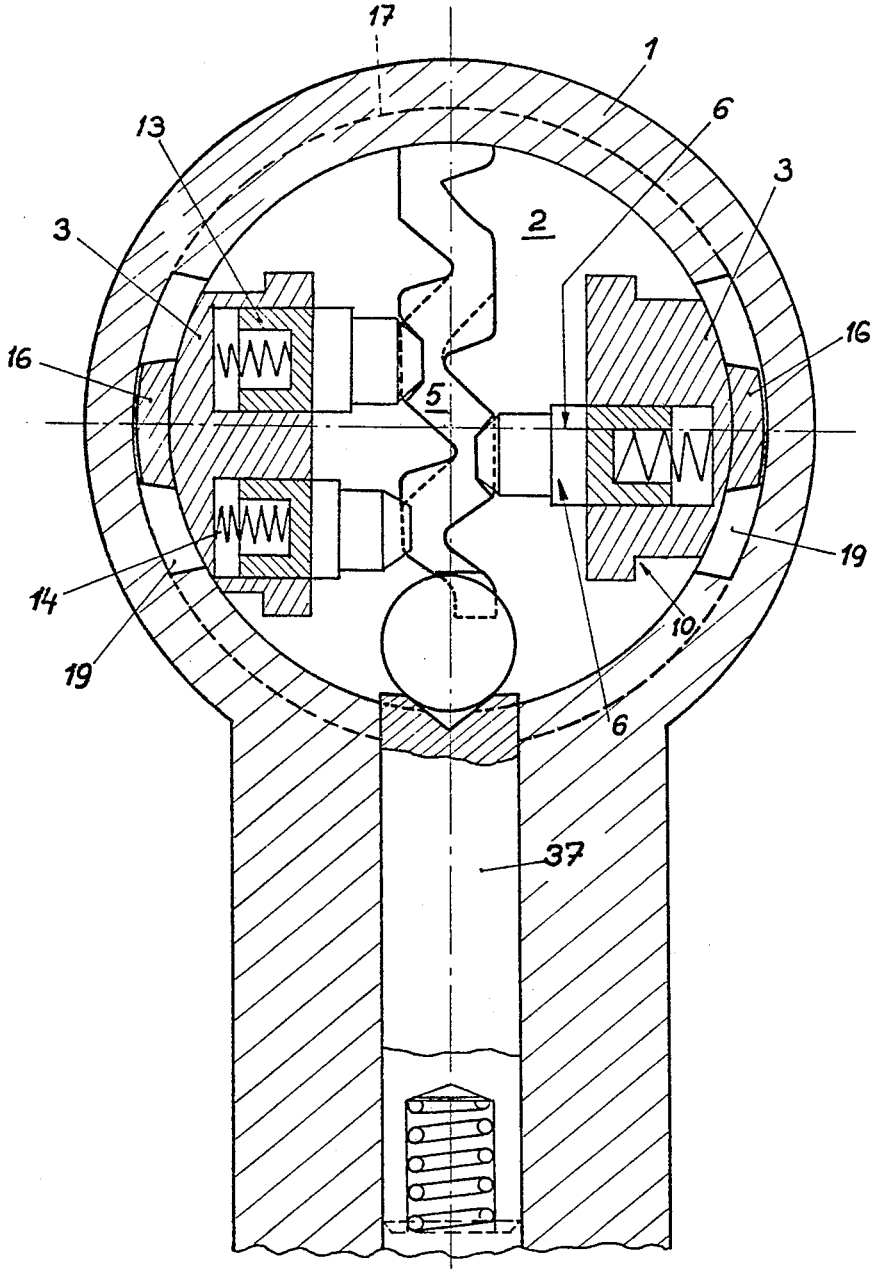
FIG. 12 shows in a sectional front view a modification of the lock of FIGS. 2 and 3.

The lock construction according to FIG. 12 corresponds substantially to the lock embodiment according to FIG. 3. Also in this example the balls 33 and 34 are eliminated. The key holding pin 37 is also preferably made of a hard metal to protect the lock against breakage by drilling.

Figure 13:
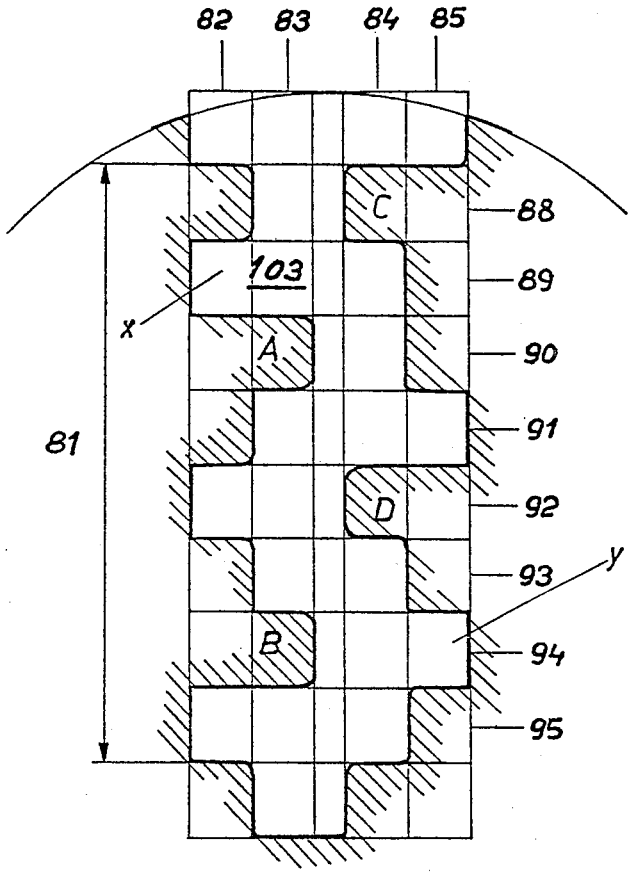
FIGS. 13–15 show schematically another feature of this invention, namely the relationship between stable and variable profile sections in one embodiment of the key of this invention, shown in a vertical section.
Figure 14:
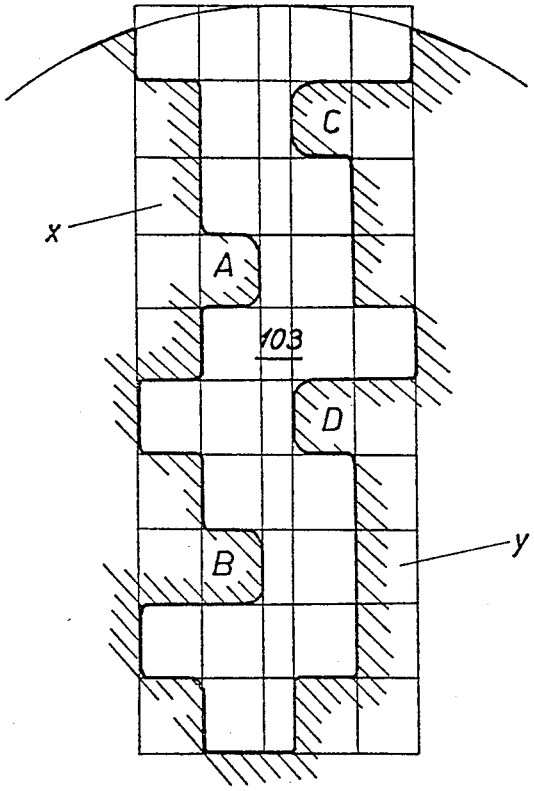
Figure 15:
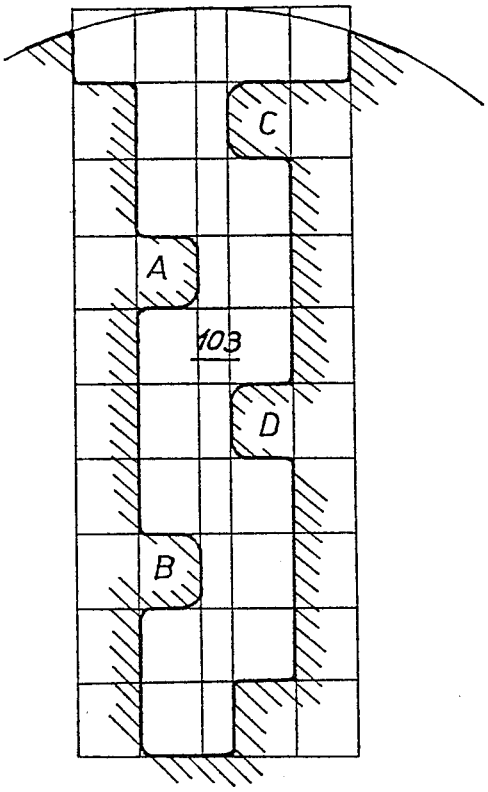

In FIG. 13, the key channel is indicated by reference numeral 103. It will be seen from FIG. 13 that the section shape of the key bit can be determined by a grid of columns 82–85 and rows 88–95. The profile section A, B, C and D of the invariable base profile are located in columns 83 and 84, whereas the elements x, y of the variable profile are located in the remaining columns 82 and 85. It is evident that in the entire section shape there are more variable profile elements than the profile elements A, B, C and D of the base profile. The key channel 103 according to FIG. 13 is of a relatively complex shape, having a large number of ribs and grooves. A simplified version of the key channel is shown in FIG. 14. The profile elements x, y, which in the embodiment of FIG. 13 are constituted by grooves, are omitted in FIG. 14. Otherwise the overall shape of the channel 103 in FIG. 14 is the same as in the preceding embodiment. A still more simplified version of the key channel is illustrated in FIG. 15, where all grooves of the variable profile are missing. The resulting section shape of the key channel 103 in FIG. 15 thus represents the so-called basic or main profile, as used in the entire installation of locks according to this invention.

It will be noted that the key pertaining to the key channel of FIG. 15 is the so-called master key or a main key. The master key is made without any ribs, corresponding to variable profile sections inasmuch as, as mentioned before, the corresponding basic key channel 103 is made without the corresponding grooves. Therefore, it is the simplest key in the system. By means of the master key it is possible to lock or unlock locking devices provided not only with the key channel as shown in FIG. 15 but also the locking devices with key channels according to FIGS. 13 and 14. The key illustrated in FIG. 14 is already a subordinate key which can open the lock with the key channel according to FIG. 13 but cannot open the lock according to FIG. 15. The most subordinate type of key is that of FIG. 13, which is shaped exclusively for operating a lock of the illustrated type of key channel. The most subordinate key has the most complex section shape. With regard to the key-keyhole combination according to FIGS. 13–15, it will be noted that the total profile of the key permits eight variations on each side thereof, corresponding to eight rows 88–95. In total there are sixteen variation possibilities. Of these, four variation possibilities relate to the base profile A, B, C and D, and the remaining twelve variation possibilities are reserved for the variable profile sections of the installation. Hence, the aforementioned four variable possibilities are not employed for the design of a lock installation but are employed as a general main profile in the production of all locking plugs. A further advantage of this profile arrangement is the fact that the base profile, consisting of four grooves or ribs, when necessary, can be subject to additional variations.

With reference to the embodiments of the keys and key channels according to FIGS. 16–19, it will be seen that, in contrast to the embodiments of FIGS. 13–15, the main or master key has the most complex profile, whereas the subordinate key is the simplest one. This important characteristic of the section shape, which when considered from the safety point of view of an installation is logically correct, is not present in conventional key shapes.

Figure 16:
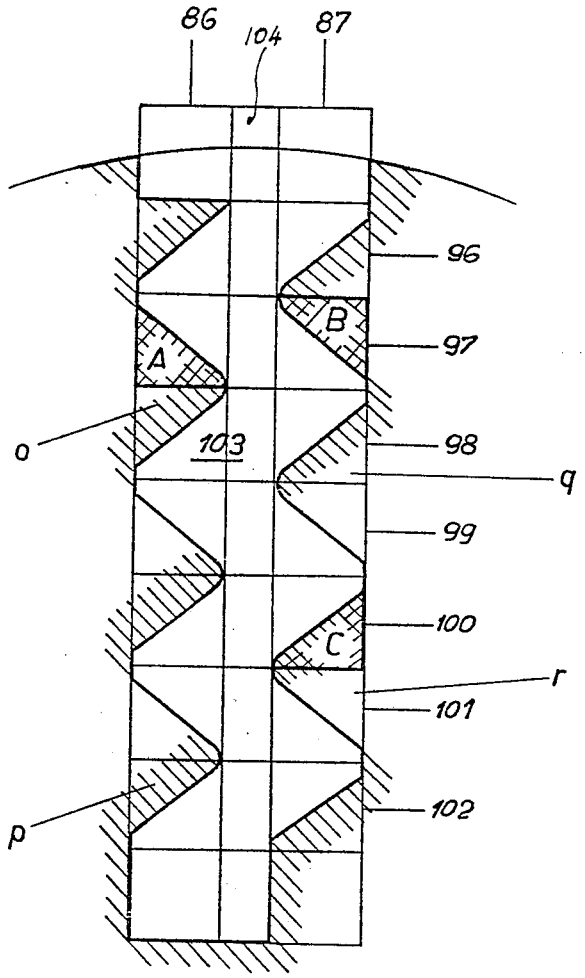
FIGS. 16–19 show the relationship between the permanent and variable profile sections in another embodiment of the key of this invention.

FIG. 16 illustrates how profile elements of the same type are arranged in columns 86 and 87, whereby altogether three elements A, B and C for the base profile and the remaining elements o, p, q and r for the variable profile (installation profile) are present. The base profile element A is located in the column 86, whereas the base profile elements B and C are in the column 87. The remaining profile elements are the installation elements o, p, q and r. The interspace between columns 86 and 87 is designated by reference numeral 104.

Figure 17:
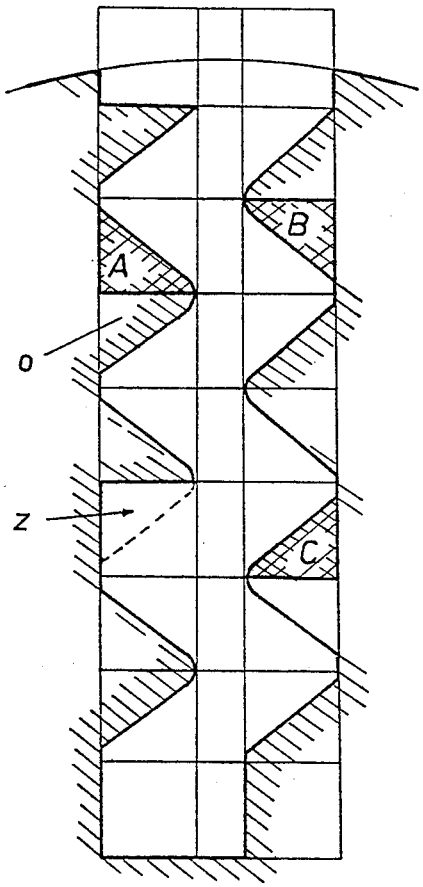
Figure 18:
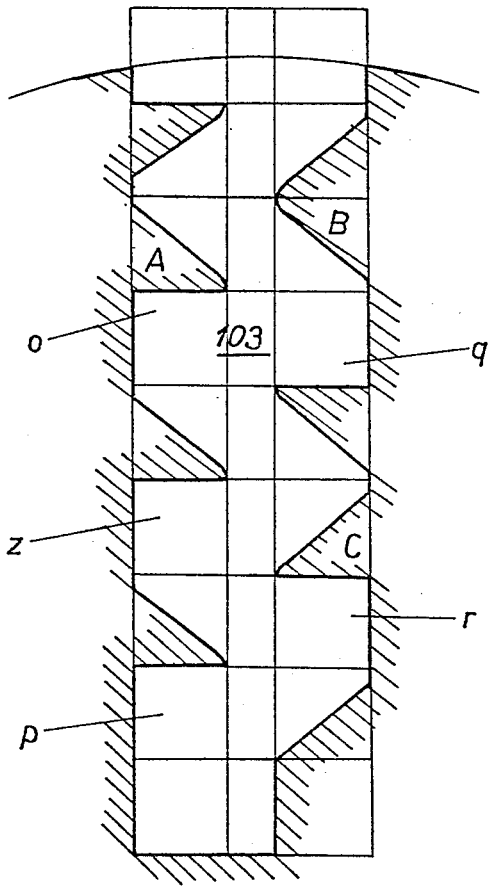

It is true that keys made in accordance with the pattern of FIG. 16 can operate all locks whose key channel has a profile corresponding to the base elements A, B and C, so that lock installations with master keys according to this embodiment would not be of advantage in many instances. In practice, a master key according to FIG. 17 is more suitable due to the rib z. This key could not operate the lock according to FIG. 16, but it could operate all other locks whose installation profile elements are modified for example in accordance with the profile according to FIG. 18. A key matching a lock with a key channel according to FIG. 18 has continuous ribs at locations o, p, q and r. The latter key can operate neither the lock according to FIG. 17, nor the lock according to FIG. 16. On the other hand, the master key according to FIG. 17 can open or close a lock of FIG. 18.

Figure 19:
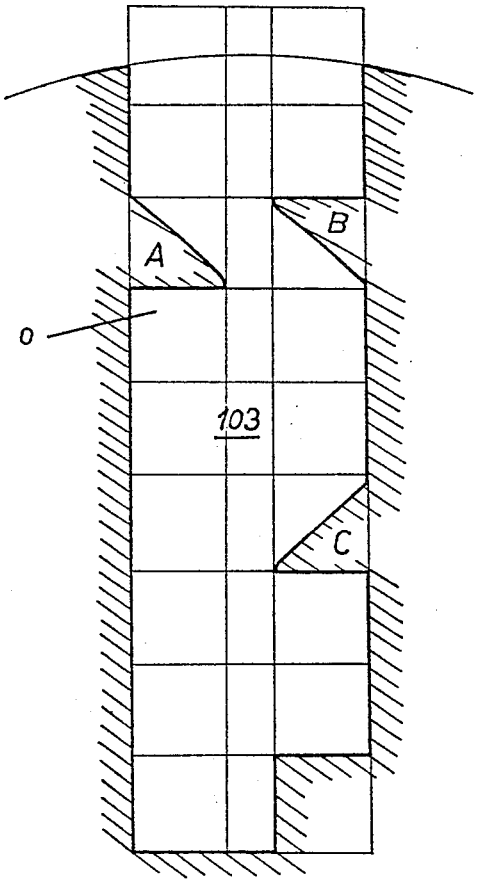

FIG. 19 illustrates a key channel 103 for a subordinate lock. In this embodiment, only the base profiles A, B, C are present. All installation profiles are eliminated, and due to its very simple form this key can operate a lock whose key channel corresponds to FIG. 19.

From the above examples it is evident that by using a key-lock combination according to this invention a very large number of variations is available, inasmuch as the base profile and the installation profile can be manufactured with the most diverse variations. Moreover, in the illustrated examples, for example in the construction according to FIGS. 13–15, the base profile and the installation profile can be alternately arranged in different columns. For instance, the base profile can be situated also in columns 82 and 85 and the installation profile in columns 83 and 84. Also, a mixture of the two kinds of profiles is conceivable in respective columns. Of course, a further variation possibility resides in the fact that the ribs and the grooves may have different configurations, as is well known in the art. The additional advantages of this invention can be summarized as follows:

1. The profile grooves reserved for the main profile may have different form and number, which can be still further modified. In this manner it can be achieved that, for example, two large lock installations, each having a master key, can be operated with a single superordinate key.

2. Since the installation profile is divided over the overall height of the key, the base profile can be arranged at an arbitrary base.

As has already been mentioned above, the arrangement of the base profile can be made only in the immediate proximity of the dorsal or back side of the key. This invention makes it possible that the ribs of the base profile, which generally remain in the cylinder plug, can be arranged in such a manner that the sensing of pin tumblers is considerably impeded.

3. Due to the section shape of the key according to this invention, it is rendered very difficult to machine a subordinate key in such a manner that a superordinate or master key be produced. The reason for this feature is the fact that it cannot be recognized where the base profile is situated or how many ribs or grooves are used for the latter. Furthermore, it would be very difficult to imitate the correct triangular shape. For instance, if a subordinate key be milled or filed parallel to its center axis in order to remove the ribs, then the overall cross section of the key would be so reduced that the key would break. Finally, it is also of substantial advantage in the lock and keys of this invention that the manufacture of the inventive profile in the cylinder plug is substantially less costly than in prior-art locks of this kind.

In manufacturing conventional key channel profiles, it is necessary to use (for the cylinder plug) a set of broaching tools consisting of about ten individual cutters for the base profile. Hence, the resulting profile is fixed and cannot be additionally modified, unless again a new set of cutters be produced.

The set of broaching tools for the variable profile consists, depending on the desired number of combinations, of about twenty-four cutters. By clamping different broaching cutters in different sequences, the required variations are achieved. Accordingly, in manufacturing a conventional lock profile according to the above example, about thirty-four cutters are needed. Since the base profile of the lock of this invention comes out from the installation profile, that is it is identical as to its form with the latter, a set of about twenty-four broaching tools is needed. These tools or cutters can be arranged according to different patterns, so that with the same set of tools both the base profile can be manufactured and modified, and also the different installation profile combinations can be made.

According to another feature of this invention, in the overall profile of the lock and of the key, there can be provided more variable profile elements (for example x, y, o, p, q, r) than the base profile elements A, B, C, D. The base profile elements A, B, C, D are provided in predetermined columns 83, 84 and the variable profile elements x, y, o, p, q, r are in other columns 82, 85 (FIGS. 13–15). In another embodiment, in respective columns 86, 87 there are arranged both the base profile elements and the variable profile elements (FIGS.

16–19). According to the embodiment of FIGS. 13–15, an overordinate or master key (general key) is relatively simple, having only a few ribs and grooves, and a subordinate key is relatively complicated, having many ribs and grooves.

In another modification of this invention according to FIGS. 16–19, a superordinate key (general key) is relatively complicated, by using a large number of ribs and grooves, whereas a subordinate key is relatively simple and uses a low number of ribs and grooves. In the embodiments of FIGS. 16 or 17 the master key is the complicated one, and in the embodiment of FIG. 19 the subordinate key is the simplest one.

An arbitrary mixture of the two kinds of profiles can be used in a single column. Since the installation profile is divided over the overall height of the key, the base profile can be arranged at an arbitrary location. Among the features of this invention is also the fact that the two kinds of profile can be distributed over the entire effective range of the key, whereby the two profiles can join each other in an arbitrary sequence without the necessity that the base profile be situated in an immediate proximity to the back side of the key. By virtue of this invention, the ribs of the base profile, which generally remain in the cylinder plug, can be arranged in such a manner that the sensing of the pin tumblers is rendered difficult.

According to the invention, a large number of key-lock variations can be manufactured in the most advantageous manner, whereby the cross section of respective profile types are always of sufficiently large size which ensures that the function of the lock-key combination is not impaired by wear. Finally, the manufacture of the lock of this invention is simple and inexpensive.

Figure 20:
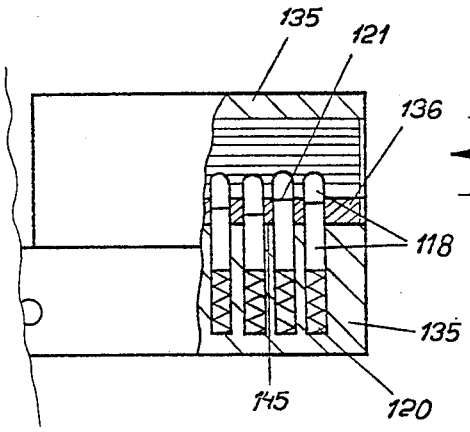
FIG. 20 shows, in a partly cut away front view, still another embodiment of this invention.
Figure 21:
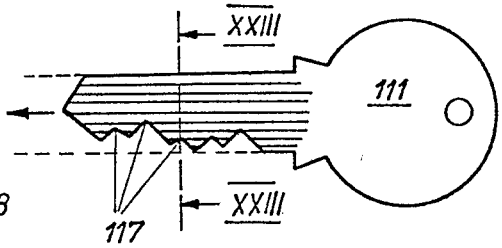
FIG. 21 illustrates a key pertaining to the lock of FIG. 20.
Figure 22:
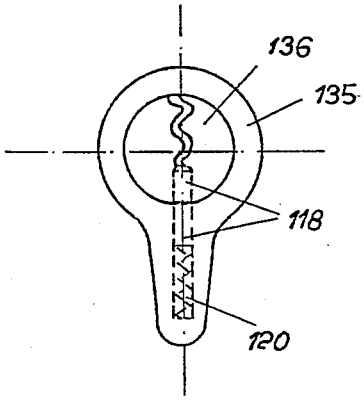
FIG. 22 is a front view of the lock of FIG. 20.

FIGS. 20–22 illustrate the overall arrangement of lock-key combinations whose key channel profile will be explained with reference to FIGS. 23–27. In FIG. 20, the cylinder housing 135 encloses again a cylinder plug 136 which is rotatable about its axis in conventional manner, so that upon insertion of a correct key 111 the control recesses 117 displace the segmented pin tumblers 118 into such a position in which the separation planes 121 of the tumblers coincide with the separation plane 145 between the housing and the plug 136.

Figure 23:
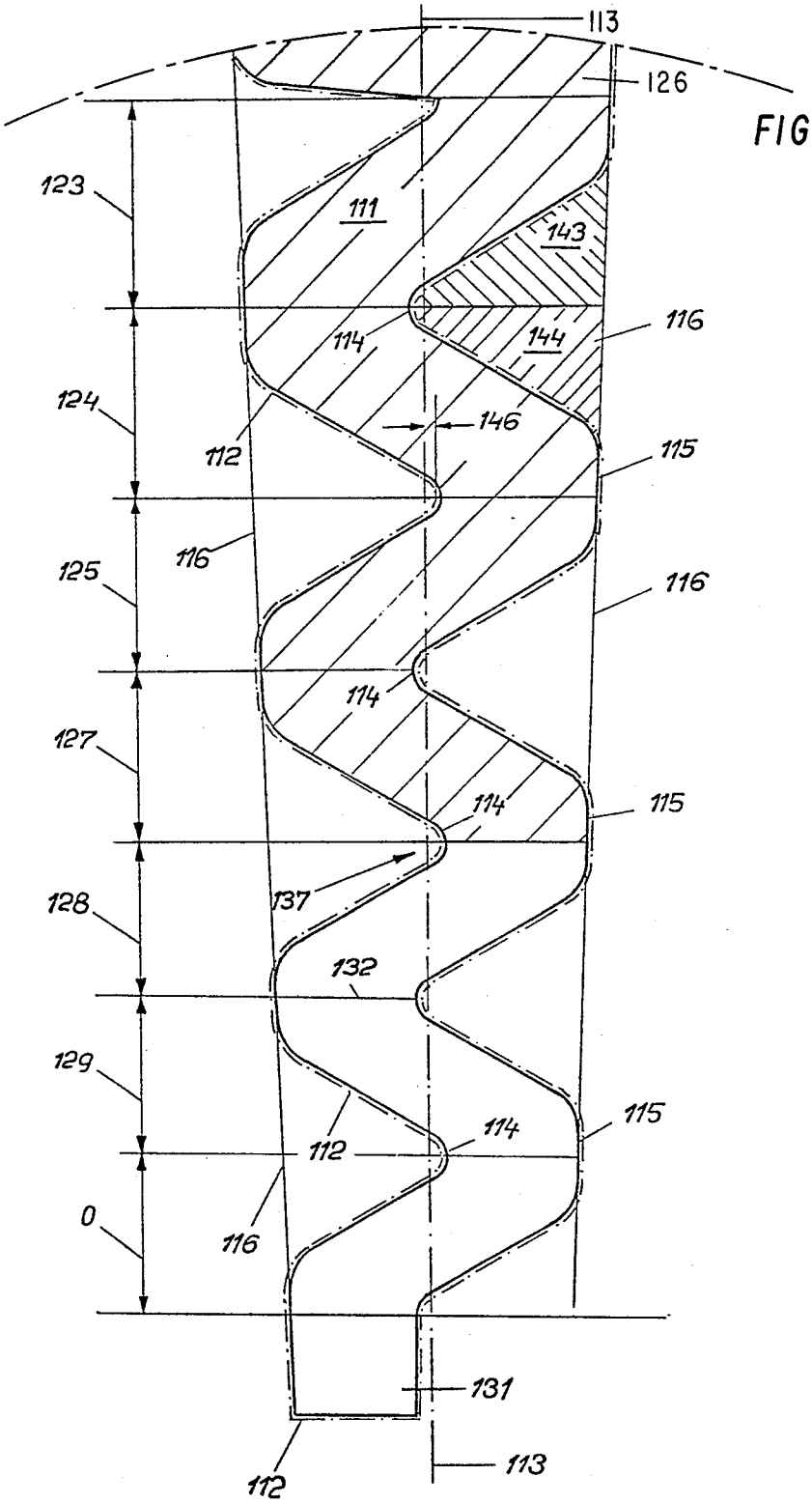
FIG. 23 shows on an enlarged scale the bits of the key of FIG. 21, taken along the line XXIII—XXIII.
Figure 24:
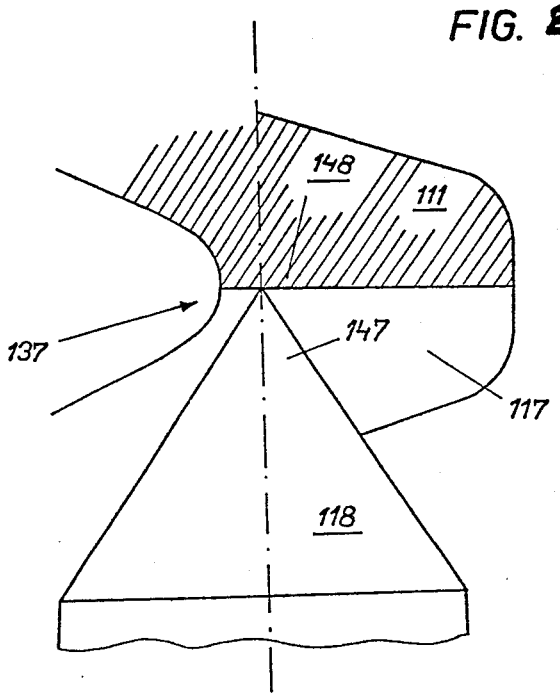
FIGS. 24–27 show schematically structural details of the lock of FIG. 20.

The key profile illustrated in FIG. 23 corresponds generally to that of the key 111 and to the key channel 112 in FIG. 20. Each profile element includes a depression 114 and a crest 115, the depression and the crest being interconnected by a non-illustrated intermediate piece. All these profile elements are substantially of a rhomboid configuration. It will be seen from FIG. 23, in the range of a central plane 113 of the key, the bottoms of the depressed portions extend about a certain distance 146 over the central plane. The illustrated profile also includes profile elements 114, 115 of different graduation or pitch, that is with different spacing between the depressions 114 and the crest 115. Furthermore, it will be seen that the contour lines 116 of the key bit define a conical shape. The lower side of the key 111, as seen from FIG. 21, is provided with control recesses which cooperate with the segmented pin tumblers. Referring again to FIG. 23, the spacings 123, 124 and 125 in the upper range of the key 111 decrease in the direction away from the back side 126 of the key, whereas the spacings in the lower range of the key (spacings 125, 127, 128, 129 and 130) are approximately of the same size. It will also be noted that the conical cross section of the key bit converges from the back or dorsal side of the key towards its lower side. The combination of all these aforedescribed features contributes to the solution of objectives of this invention.

FIGS. 24–27 clarify the details of the embodiment of FIG. 21. The detail according to FIG. 24 corresponds to the region 127 in FIG. 23. The conical tip 147 of pin tumblers 118 is pressed by the corresponding biasing spring against the material 148 in the recess 117 of the key 111. Full lines of the tumbler 118 indicate that the latter cooperate with a correct key which ensures that the separation plane between the segments of the pin tumbler and the separation plane 145 between the cylinder housing 135 and the cylinder plug 136 are flush with one another.

Figure 25:
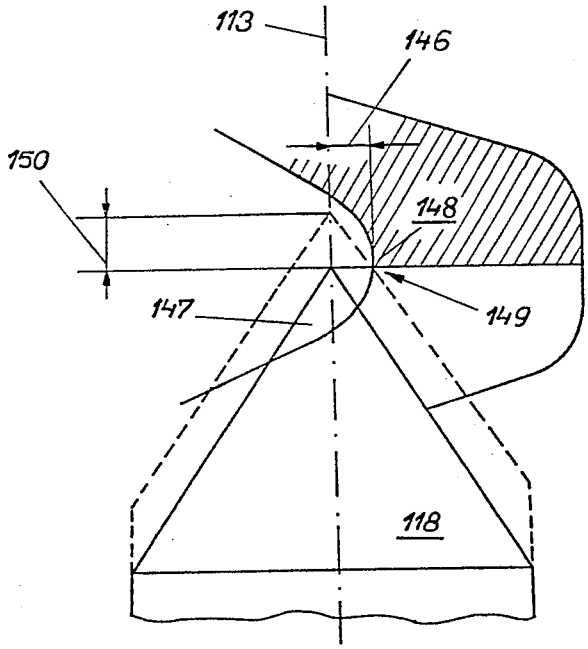

FIG. 25 illustrates an overlapping 146 of the depressed part of the key profile relative to the central plane 113 of the key. Due to this overlapping, no key material is present opposite the tip 147 of the pin tumbler 118, and consequently the biasing spring of the tumbler displaces the same in a position illustrated by a dashed line. Only in this position is the tip 147 brought in contact at the point 149 with the material 148 of the key. However, the pin tumbler is displaced by the distance 150 beyond the correct position, and the lock cannot be operated inasmuch as the division plane 121 no longer coincides with the separation plane 145.

Figure 26:
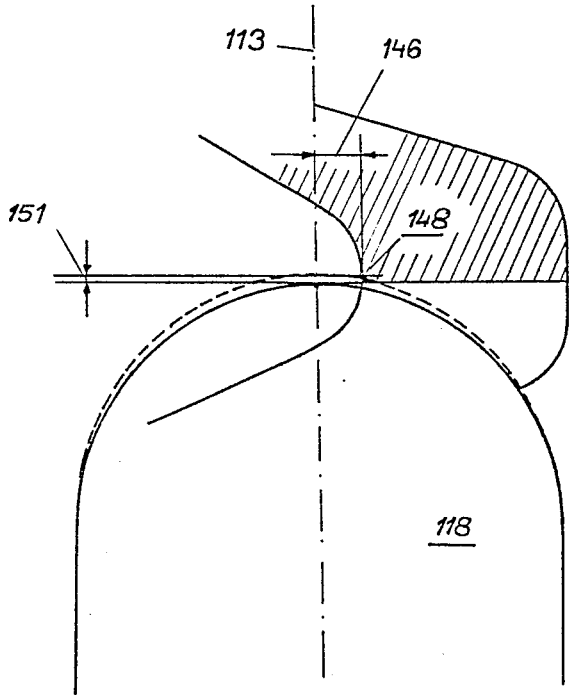
Figure 27:
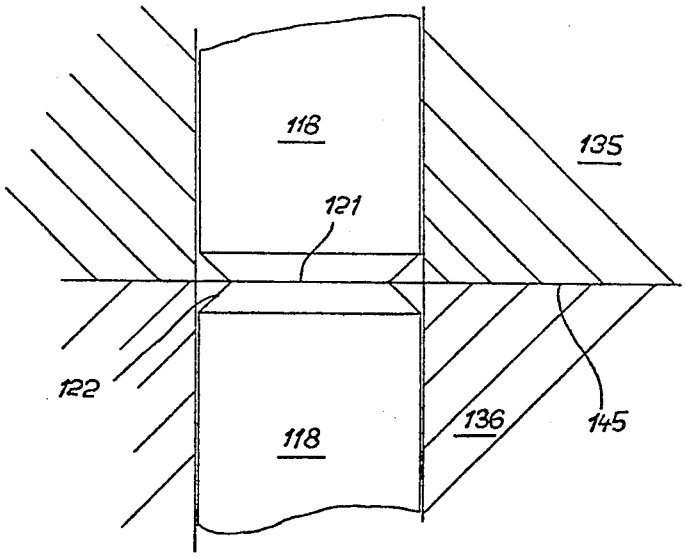

It will be seen from FIG. 26 that the aforementioned undesired condition is avoided by the provision of a pin tumbler whose end which cooperates with the key recess 117 has a semispherical configuration. The correct position of the pin tumbler is again indicated by full lines, whereas the excessively deep position thereof is indicated by dashed lines. It will be seen that, even if no key material is present opposite the cast point of the pin tumbler, the latter, due to the spherical surface at its end, can override the correct position only by a minute distance 151, which does not impair the operation of the key. The division plane 121 of the tumblers and the separation plane between the cylinder housing and cylinder plug therefore are sufficiently close one to another that the small distance 151 can be rendered ineffective. For this purpose, the adjoining tumbler segments are provided with bevels 112 (FIG. 27) which permit the rotation of the plug when the separation plane 121 is within the tolerances defined by the distance 151. The measure of the aforementioned overlapping 146 of the curvature of the spherical end of the pin tumbler 118 and the magnitude of the bevelled surfaces 122 are geometrically interrelated and, depending on the desired overlapping, they can be easily determined.

It is evident that the variability of the lock of this invention is greatly increased by the application of different constructions of the component parts which determine the profile of the key channel and of the key. As discussed before, the multitude of variation possibilities is in principle also due to the fact that the profile elements 143, 144, which as illustrated in FIG. 23 have a triangular outline, can be dispensed with.

It will be understood that each of the elements described above, or two or more together, may also find a useful application in other types of constructions differing from the types described above. For instance, the end of the pin tumblers cooperating with the key recesses 117 may also have a trapezoidal shape.

While the invention has been illustrated and described as embodied in specific examples of a lock-key combination, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cylinder lock arrangement having a cylinder housing and a cylinder plug rotatable about a central axis in said housing, said cylinder plug being formed with at least one axially directed recess, a blocking bar movable in axial direction in said recess in the cylinder plug between a blocking position in which it blocks the rotation of the plug relative to the housing and a releasing position, a key channel formed in said plug parallel to said recess, said key channel communicating with said recess via a plurality of radial bores in said plug, comprising a plurality of blind bores formed in said blocking bar; segmented pin tumblers arranged in said blind bores and in said radial bores so that upon insertion of a correct key the separation plane between the segments of the pin tumblers coincides with the separation plane between the blocking bar and the cylinder plug; and means arranged in said cylinder housing in the path of movement of the blocking bar to adjust the axial position of the latter when the plug is rotated by a key in the key channel.

2. A key for the cylinder lock arrangement as defined in claim 1, comprising a key bit defining narrow upper and lower sides and broad lateral sides and a central axis, a plurality of control surfaces arranged along at least one of the broader sides of the key bit to cooperate with the assigned segmented pin tumblers, said control surfaces being arranged one after the other along a line extending parallel to said center axis and being provided at different levels matching the separation planes of the segments of the pin tumblers.

3. A key as defined in claim 2, wherein said control surfaces are arranged in a continuous groove extending in the direction of the center axis.

4. A key as defined in claim 3, wherein the transitions between respective control surfaces in the continuous groove are continuous so that the depth of the groove has the outline of a continuous wave.

5. A cylinder lock arrangement as defined in claim 1, wherein the inner wall of the housing is formed with an axial groove, said blocking bar including a solid extension projecting into said axial groove, an annular groove formed in the inner wall of the housing and intersecting said axial groove to receive said solid extension when said blocking bar has been adjusted into its releasing position by inserting a correct key so as to permit the full rotation of the plug relative to the housing; said means for adjusting the axial position of the blocking bar including a stop ring coupled to the housing via a load limit coupling, said stop ring including sloping surfaces engageable with the end of said blocking bar to displace the same in axial direction when said plug is rotated.

6. A cylinder lock arrangement as defined in claim 5, wherein said blocking bar is formed with lateral shoulders and said recess in the plug being provided with undercuts for slidably engaging said shoulders so as to guide the blocking bar in axial direction while securing the bar against movement in the radial direction.

7. A cylinder lock arrangement as defined in claim 6, wherein said segmented pin tumblers and the corresponding bores in said blocking bar and in said plug are step-wise reduced in diameter toward said key channel so that the tumbler segment communicating with the key channel has the smallest diameter.

8. A cylinder lock arrangement as defined in claim 6, wherein the separation plane between the blocking bar and the plug extends parallel to a side of the key channel, and further including a key provided with control surfaces arranged on the side of the key facing said separation plane.

9. A cylinder lock arrangement as defined in claim 6, wherein the segment of the pin tumbler which is arranged in the blind bore in the blocking bar is provided with a well for accommodating a biasing spring; said biasing spring resting on the bottom of a blind bore in the blocking bar.

10. A cylinder lock arrangement as defined in claim 6, wherein the separation planes of respective segments of the pin tumblers and the separation plane between the blocking bar and the cylinder plug have a planar shape, respectively.

* * * * *

UNITED STATES PATENT AND TRADEMARK OFFICE

CERTIFICATE OF CORRECTION

PATENT NO. : 4 612 787

DATED : September 23, 1986

INVENTOR(S) : Kurt Prunbauer and Adalbert Paar

It is certified that error appears in the above—identified patent and that said Letters Patent is hereby corrected as shown below:

On the title page:

In the heading [73]the name of the assignee should rad:

--EVVA-WERK Spezialerzeugung von Zylinderund Sicherheitsschlössern Gesellschaft m.b.H. & Co--

Signed and Sealed this

Third Day of March, 1987

*Attest:*

DONALD J. QUIGG

*Attesting Officer*

*Commissioner of Patents and Trademarks*